US012349847B2

(12) United States Patent
LeCompte et al.

(10) Patent No.: US 12,349,847 B2
(45) Date of Patent: Jul. 8, 2025

(54) MOP HEAD AND SELF-WRINGING MOP APPARATUS AND ASSEMBLY AND METHOD OF WRINGING A MOP

(71) Applicant: MICRONOVA MANUFACTURING, INC., Torrance, CA (US)

(72) Inventors: Phillip LeCompte, Anaheim, CA (US); Kristin Stewart, Harbor City, CA (US)

(73) Assignee: MICRONOVA MANUFACTURING, INC., Torrance, CA (US)

( * ) Notice: Subject to any disclaimer, the term of this patent is extended or adjusted under 35 U.S.C. 154(b) by 653 days.

(21) Appl. No.: 17/368,855

(22) Filed: Jul. 7, 2021

(65) Prior Publication Data

US 2022/0133117 A1 May 5, 2022

Related U.S. Application Data

(63) Continuation of application No. 16/060,924, filed as application No. PCT/US2016/065992 on Dec. 9, 2016, now Pat. No. 11,058,277.

(60) Provisional application No. 62/265,386, filed on Dec. 9, 2015.

(51) Int. Cl.

| | |
|---|---|
| ***A47L 13/258*** | (2006.01) |
| ***A47L 13/144*** | (2006.01) |
| ***A47L 13/146*** | (2006.01) |
| ***A47L 13/20*** | (2006.01) |
| ***A47L 13/256*** | (2006.01) |

(52) U.S. Cl.

CPC ..... *A47L 13/146* (2013.01); *A47L 13/144* (2013.01); *A47L 13/20* (2013.01); *A47L 13/256* (2013.01); *A47L 13/258* (2013.01)

(58) Field of Classification Search

CPC ..... A47L 13/144; A47L 13/258

See application file for complete search history.

(56) References Cited

U.S. PATENT DOCUMENTS

| | | | | |
|---|---|---|---|---|
| 2,730,744 A | | 1/1956 | Vaughn | |
| 3,147,502 A | | 9/1964 | Richards | |
| 4,481,688 A | * | 11/1984 | Graham | A47L 13/144 15/119.2 |
| 4,864,675 A | | 9/1989 | Jones | |
| 5,131,111 A | | 7/1992 | Richardson et al. | |

(Continued)

FOREIGN PATENT DOCUMENTS

| | | |
|---|---|---|
| GB | 2429633 | 3/2007 |
| GB | 2445727 | 7/2008 |

(Continued)

OTHER PUBLICATIONS

Soo, Eng Wei, International Search Report, Mar. 6, 2017, 5 pages, Australian Patent Office, PO Box 200, Woden ACT 2606, Australia.

(Continued)

*Primary Examiner* — Randall E Chin

(74) *Attorney, Agent, or Firm* — VIKING IP LAW; Scott R. Hansen

(57) ABSTRACT

Flat mops and self-wringing flat mops can include a wringing configuration for applying a linear wringing motion to a mop head assembly, such as may occur along an axis coaxial with a handle. Four-point self wringing configurations may include four-point guide surfaces and/or four-point pressure points for wringing a mop head assembly.

25 Claims, 10 Drawing Sheets

(56) References Cited

U.S. PATENT DOCUMENTS

| | | | | |
|---|---|---|---|---|
| 5,172,446 | A * | 12/1992 | Schulein | A47L 13/144 15/116.1 |
| 5,272,783 | A | 12/1993 | Richardson et al. | |
| 6,487,746 | B1 | 12/2002 | Cioci | |
| 6,675,426 | B2 | 1/2004 | Ohm et al. | |
| 6,854,150 | B2 | 2/2005 | Hirse | |
| 7,257,853 | B2 | 8/2007 | Boyer et al. | |
| 8,225,452 | B2 | 7/2012 | Fischer | |
| 8,943,638 | B1 | 2/2015 | Armaly, Jr. | |
| 11,058,277 | B2 | 7/2021 | LeCompte et al. | |
| 2002/0120994 | A1 | 9/2002 | Hirse | |
| 2003/0101527 | A1 | 6/2003 | Specht et al. | |
| 2006/0137121 | A1 | 6/2006 | Niccolai | |
| 2011/0209300 | A1 | 9/2011 | Dinger et al. | |

FOREIGN PATENT DOCUMENTS

| | | |
|---|---|---|
| WO | WO 2012/146329 | 11/2012 |
| WO | WO 2013/018022 | 2/2013 |

OTHER PUBLICATIONS

Soo, Eng Wei, Written Opinion of the International Searching Authority, Mar. 6, 2017, 6 pages, Australian Patent Office, PO Box 200, Woden ACT 2606, Australia.

Trimarchi, Roberto, Extended European Search Report, Aug. 7, 2019, 5 pages, European Patent Office, 80298 Munich, Germany.

Spontex.com—Quick Max Flat Mop, Spontex Webpage, May 2015, Spontex, United Kingdom.

* cited by examiner

MOP HEAD AND SELF-WRINGING MOP APPARATUS AND ASSEMBLY AND METHOD OF WRINGING A MOP

CROSS REFERENCE TO RELATED APPLICATIONS

This application is a continuation of Ser. No. 16/060,924 filed Jun. 8, 2018, now U.S. Pat. No. 11,058,277 issuing Jul. 13, 2021, which is a National Stage of International Application No. PCT/US16/65992, filed Dec. 9, 2016, and published as WO2017/100687, which claims priority to U.S. Provisional Application No. 62/265,386 filed Dec. 9, 2015, the entire contents of all of which are incorporated herein by reference.

BACKGROUND

Field

These inventions relate to flat mops and self-wringing flat mops.

SUMMARY

Flat mops may include self-wringing configurations that apply a linear wringing motion to wring a mop head. Flat mops may also include pressure surfaces to apply pressure for generating a wringing action. Flat mops may also include self-wringing configurations using a perimeter structure for applying or generating a wringing action. Additionally, flat mops may also include four-point self-wringing configurations. In one example of a linear wringing motion, a wringing action may be applied by moving an assembly along a linearly-extending handle, for example toward a mop head. In one configuration, the mop head is an assembly of wings or half plates that can pivot toward each other, for example by action of a wringing assembly. In another configuration, a mop head assembly formed by assembly of wings or half plates may include one or more of angled or cam surfaces for initiating or progressing wringing action, edge profiles for assisting in cleaning coving or other surface configurations, and securement elements for removably receiving mop head material, for example hook or other fabric holding constructions for holding mop head material.

In one example of a self-wringing mop configuration, such as for example for flat mops including bi-wing or half plate mop heads, a perimeter structure can be used to apply pressure or friction for wringing liquid from mop head material. In one configuration, the perimeter structure may be one such as to place a perimeter around a portion of a mop head, for contacting the mop head and for applying a wringing action to the mop head. In such a configuration, the perimeter structure can also be configured to move along surfaces of the mop head to apply a wringing action over a desired extent of the mop head. For example, the perimeter structure can be configured to apply pressure or friction to the mop head, and move along the mop head to apply such pressure or friction over the mop head, as desired. In one configuration, rollers are used in the perimeter structure to apply pressure to the mop head for a wringing action. In another configuration, blades or other surface configurations can be used in the perimeter structure to apply pressure or friction to the mop head for a wringing action. In an example of rollers, blades or other surface configurations, such rollers, blades or surface configurations may have a profile or surface configuration that applies a wringing function to multiple surfaces, for example a planar surface and a side surface of a mop head.

In one example of a perimeter structure for use with a self-wringing mop configuration, the self-wringing mop assembly has a perimeter structure that extends around four sides of a mop head when in a wringing configuration. In one configuration of a four-sided perimeter structure, the structure can include four rollers or four pressure surfaces for applying a wringing action to a mop head. In another configuration of a perimeter structure, the perimeter structure is an integral structure, for example forming a perimeter around a mop head when in a wringing configuration. In a further configuration of a perimeter structure, the perimeter structure may include guide surfaces that guide the perimeter structure so that the perimeter structure can extend over a mop head assembly for wringing. In one example, the guide surfaces may include grooves or channels for engaging complimentary structures on the assembly. The grooves or channels can be V-shaped channels or U-shaped channels, or grooves or channels having other profiles complementary to guide structures on the mop. In other configurations, the guide structures can be posts, poles, columns or other linearly-extending structures for allowing the perimeter structure to move linearly relative to the mop.

In another configuration of a self-wringing mop, having a four-point self-wringing configuration, a self-wringing assembly can include structures for applying pressure or wringing function, for example at four locations. The structures, or wringing means, can include friction surfaces such as blades, scrapers or moisture shedding structures, and/or they can include rollers or other pressure-applying surfaces. In another configuration of a self-wringing to mop having four-point self-wringing configuration, the mop may include a self-wringing assembly configured to travel on a support structure having four guide points or paths. In one example, the wringing assembly may be guided by a combination of complementary points or rails and channels or grooves allowing the wringing assembly to travel linearly.

A mop such as a wet mop can be wrung out by moving a wringing structure toward a mop structure in a direction parallel to the mop handle. In one example, the mop can be wrung out by moving a wringing structure having four points or four areas of contact into contact with adjacent surfaces on a folding mop structure. In another example, the mop can be wrung out by moving a wringing structure having four contact rollers into contact with adjacent surfaces on a folding mop structure, and moving the wringing structure along the folding mop structure in such a way that the rollers roll over contacting surfaces of the mop structure. In a further example, the mop can be wrung out by moving a wringing structure having four areas of contact into contact with edge surfaces of a folding mop structure, for example using rollers to contact the edge surfaces of the mop structure. In any of the foregoing examples of moving a wringing structure toward a mop structure, moving the wringing structure can be carried out by moving a manual grip along the handle, which thereby moves the wringing structure. In one configuration, movement of the wringing structure in the foregoing examples can be guided by a guide body having one or more guide surfaces, for example where the guide body is securely supported by the mop handle.

In any of the foregoing examples of a mop assembly or method of wringing out a mop assembly, the mop assembly can include an articulating interface or adapter between a handle and a mop structure, for example able to pivot about 2 different axes, and the mop structure can be self-aligning.

In one example, a mop structure can be self-aligning when it comes into contact with a frame of a wringing structure. In another example, a mop structure can be self-aligning when it comes into contact with a frame of a wringing structure, for example where the mop structure can contact the frame at at least four spaced-apart locations by which the mop structure can be put back toward the desired alignment, for example for wringing.

In any of the foregoing examples of a method of wringing out a mop assembly, a folding mop structure having perimeter side edges can be wrung out by applying pressure or a wringing function to one or more of the side edges at the perimeter of the mop structure. In one example, wringing occurs when the mop structure is folded together and rollers apply pressure to side edges of the mop structure. In one configuration, wringing pressure increases as a function of distance from a proximal position to a distal position along the mop structure. In another configuration, folding of the mop structure is initiated by one or more rollers, either with or before wringing begins.

These and other examples are set forth more fully below in conjunction with drawings, a brief description of which follows.

DETAILED DESCRIPTION

Figure 1:
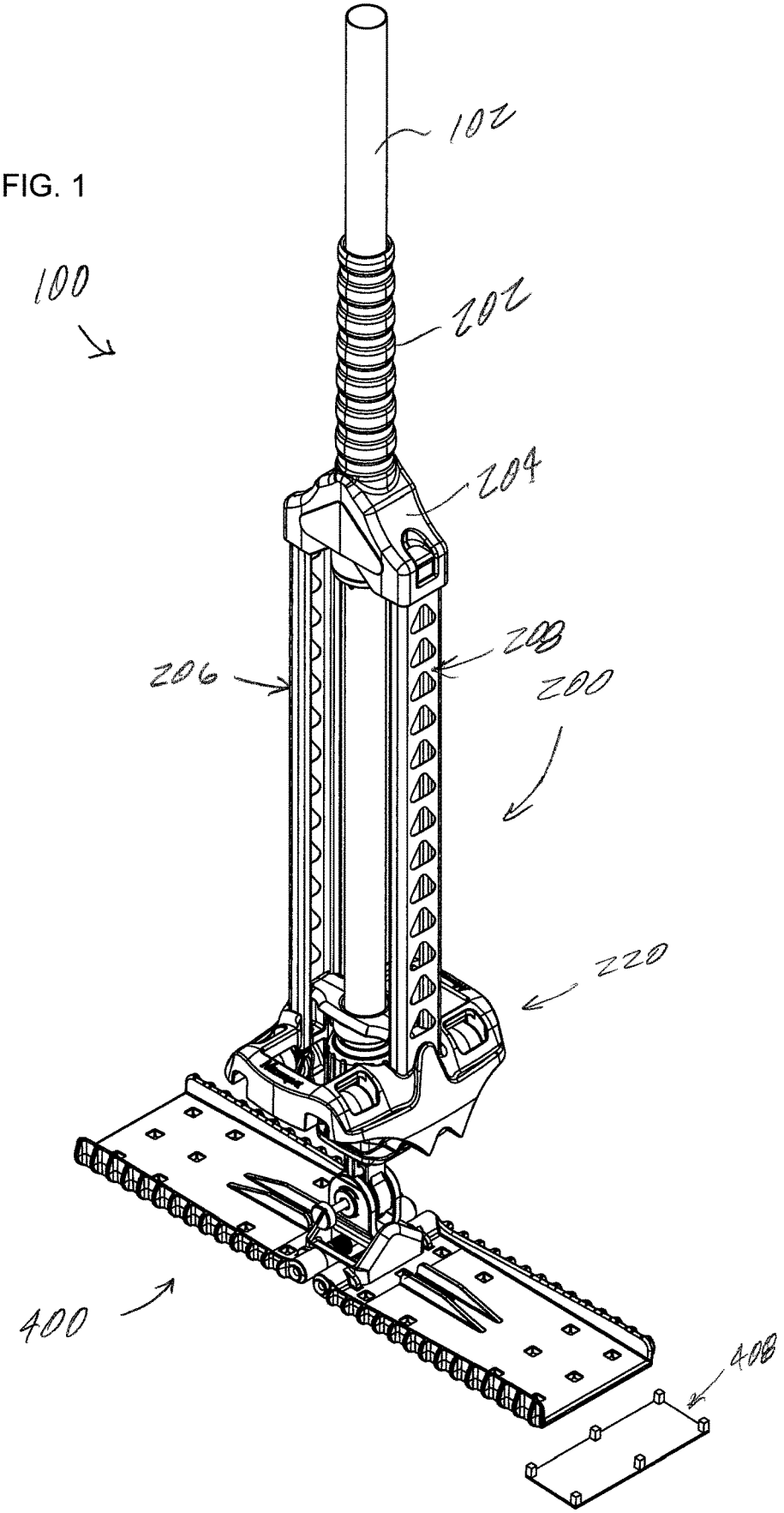
FIG. 1 is an upper left front isometric view of a mop assembly having a self-wringing configuration.
Figure 2:
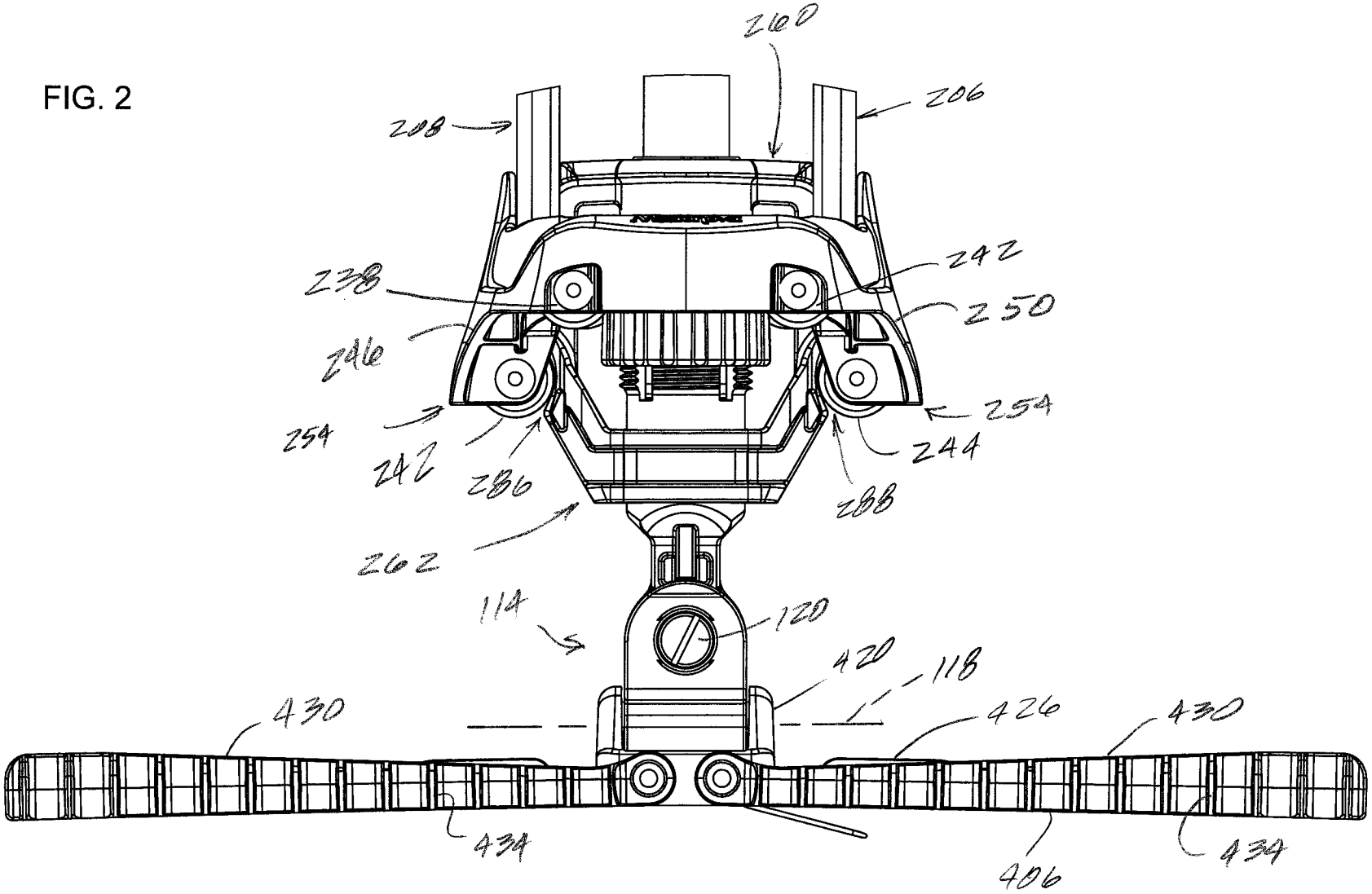
FIG. 2 is a front plan view of a detail of the mop assembly of FIG. 1.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of mops and of methods of making and using mops are described. Depending on what feature or features are incorporated in a given structure or a given method, benefits can be achieved in the structure or the method. For example, mops using a pivoting bi-plane or bi-wing mop head can be configured to be self-aligning for a wringing function or sequence, including a mop head configuration that pivots about more than one axis.

Self-wringing flat mops can also be made easier to use by incorporating a four point structure in a wringing mechanism. In one example, a wringing function can occur by applying pressure at four points along a mop head. In one configuration, four points of pressure can be applied by corresponding pressure rollers in a wringing structure. In another example, a wringing function can occur over a longitudinal extent of a mop head over a length of travel, wherein the length of travel is supported along four points of a support structure. In one configuration, the length of travel is supported through four posts, columns or spaced apart structures that help to stabilize and support the wringing function. In another configuration, the length of travel is supported through four guide combinations, which guide combinations can be identical to or different from each other, for example four combinations of V grooves and V rails or similar or other profiles allowing linear travel, including U profiles, other complementary profiles, and the like.

These and other benefits will become more apparent with consideration of the description of the examples herein. However, it should be understood that not all of the benefits or features discussed with respect to a particular example must be incorporated into a mop, component or method in order to achieve one or more benefits contemplated by these examples. Additionally, it should be understood that features of the examples can be incorporated into a mop, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of mop configurations and of methods of making and using the mops are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

As used herein, "substantially" shall mean the designated parameter or configuration, plus or minus 10%. However, it should be understood that terminology used for orientation or relative position, such as front, rear, side, left and right, upper and lower, and the like, may be used herein merely for ease of understanding and reference, and are not used necessarily as exclusive terms for the structures being described and illustrated.

A self-wringing mop assembly 100 (FIGS. 1-4 and 15-18) can take a number of configurations. In the present example, the assembly includes a wringing assembly 200 and a mop head assembly 400. As illustrated, the wringing assembly 200 is a linearly-extending and moving structure, but other configurations are possible. Similarly, the illustrated example shows the mop head assembly 400 as a flat mop or floor mop, having bi-wing or half plate pairs of mop heads, each of which can pivot relative to the mop toward each other, for example for wringing. Other mop head assembly configurations are possible, while the illustrated example will show a folding mop head configuration using two rather than one mop plate, for example.

The mop includes a linearly-extending handle 102 (FIGS. 1 and 4) having a conventional construction. The handle is threaded into a conventional Acme nut configuration 104 having a manually accessible nut 106 threaded over a compression fitting 108 for clamping the handle. The nut configuration 104 forms one end of a mop adapter 110 forming an interface between the handle 102 and the mop head assembly 400. The adapter includes a stem 112, which in the present example terminates in a universal pivot adapter 114, a 360° articulating assembly having the structure and function described and illustrated in publication WO2014/151882, all of which is incorporated herein by reference. The pivot adapter 114 allows pivoting around axis 116 (FIG. 4) and axis 118 (FIG. 2), thereby allowing pivoting relative to an X-Y plane defined by a plane of the mop head assembly 400 and perpendicular to the handle 102. The axis 116 is coaxial with the central axis of a threaded bolt 120 (FIG. 4) shown in the illustrations as being unthreaded from a mating nut 122.

The wringing assembly 200 in the illustrated example (FIGS. 1-9) includes an actuation element in the form of a manual grip 202 through which the handle 102 extends when the mop is fully assembled. The manual grip 202 includes a plurality of surfaces and extends sufficiently longitudinally relative to the handle to allow easy gripping by a user. The manual grip 202 is mounted to, secured or otherwise fixed (permanently or releasably) to a bracket 204 extending laterally relative to the manual grip 202, and therefore the axis of the handle. In the present example, the bracket 204 extends along a diameter perpendicular to the axis of the manual grip 202 on opposite sides thereof, but it should be understood that the bracket can take a number of configurations, for example depending on the number of guide structures attached to it or otherwise supported by it.

The wringing assembly 200 further includes first and second guides, hereafter identified as guideposts 206 and 208 extending longitudinally and substantially parallel to a central axis of the manual grip 202. In the present example, only two guideposts are used, but it should be understood that additional guideposts can also be used, for example four posts or another even number of post, or posts or columns distributed substantially uniformly about the central axis of the manual grip 202 (for example, three, four, five, six, etc.). The guides, or as herein identified as guideposts, help to guide the wringing assembly toward the mop head assembly for wringing the mop head assembly. The guideposts help to provide a linear movement for wringing action, for example parallel to an axis 126 of a handle, and in the present example also parallel to an axis 126 about which wings of a mop assembly are brought together.

Each of the guideposts 206 and 208 is but need not be substantially identical to and mirror images of each other as they are positioned opposite each other on the bracket 204, and only one will be described herein, it being understood that the same description applies to the other. The guidepost 206 has a length that may be selected as a function of the size of the mop head assembly and the extent of the desired wringing action. Shorter guideposts can be used with mop head assemblies having shorter half plates or wings, and longer guideposts can be used with shorter or longer half plates or wings. Alternatively, a standard guidepost length can be selected so as to wring any size of mop head assembly, and markings or other indicators can be used to identify the length of travel for the desired wringing action for a given mop head assembly. As a further alternative, a single guidepost configuration can be used and different-sized wings can be configured to produce the desired wringing action, for example based on surface or cam configurations modified to account for a fixed wringing action such as length of travel of the wringing assembly 200.

The guidepost 206 is a linearly extending structure that provides structural support for the wringing motion imposed by way of the manual grip 202. It also provides one or more guide surfaces to help in guiding the wringing assembly 200 along the mop toward and away from the mop head assembly 400. In the present example, the guidepost 206 includes first and second guide surfaces 210 and 212. The guide surfaces help to guide the wringing assembly relative to one or more complimentary guide surfaces, described more fully below. In the present example, the first and second guide surfaces 210 and 212 are oppositely-facing rails spaced apart from each other. Each guide surface is formed as a U-shaped rail having a U-shaped cross-sectional profile. Therefore, each guide surface has an arcuate convex surface, semicircular in the present example. Other shapes are also possible, including V-shaped profiles and others. While in the present example the guide surfaces 210 and 212 face each other, they can also be configured to face away from each other and engage complementary surfaces for helping to guide the wringing assembly toward and away from the mop head assembly 400.

The guidepost 206 is formed as a C-shaped profile, which may be metal or plastic. In the present example, the guidepost has a relatively wide bottom wall 214 (FIG. 5, "bottom" being the recessed portion of the C-shaped profile) and relatively short sidewalls 216 forming a shallow cavity in the profile. Other profiles for the guidepost can also be used. The bottom wall 214 is perforated to decrease the weight of the structure.

The guideposts 206 and 208 extend longitudinally to and support a wringing structure 220, mounted to and supported on end portions of the guideposts. In the present example, internally-extending tabs or flanges 222 extend into corresponding oval openings 224 (FIG. 5) in respective guideposts. The wringing structure 220 is fixed, for example releasably, to the guideposts. In the present example, the wringing structure 220 and the guideposts are secured to each other by a respective outwardly extending flange on the guidepost (below the opening 224) extending under the adjacent structure of the wringing structure and secured by a suitable fastener to the wringing structure.

In the present example, the wringing structure 220 has a perimeter configuration, in the illustrated example extending continually along at least two sides and as illustrated around four sides. The wringing structure 220 includes an integral body 226 having four sides, and may be formed or molded from a suitable plastic. In the present example, the body has a central axis that is coaxial with a central axis of the handle 102, and is symmetrical about respective planes perpendicular to each other and intersecting with each other at the central axis of the handle. The body in the present example has a rectilinear configuration having first and second sides 228 and 230, at the centers of which the guideposts are attached. The body has third and fourth sides 232 and 234, in the present example relatively shorter than the first and second sides. The third and fourth sides support and maintain the first and second sides relatively fixed and spaced apart. The first and second sides support and allow pivoting of respective pairs of rollers 236 and 238, and 240 and 242. The rollers apply pressure to corresponding surfaces or structures on the mop head assembly, as part of the wringing function. As can be seen in the illustrations, the rollers 236, 238, 240 and 242 provide four points or concentration areas of applying pressure to the mop head assembly. The wringing structure 220 is configured so that the rollers can rotate about their respective axes, and are substantially rigidly maintained in their respective spacings, to reliably apply pressure to the mop head assembly as desired. In the present configuration, the rollers 236 and 240 are positioned opposite each other and substantially in the same plane, and rollers 238 and 242 are positioned opposite each other and in substantially the same plane, which is the same plane as for rollers 236 and 240. While they need not be opposite each other or in the same plane, such configuration permits a reliable and balanced wringing function.

Figure 3:
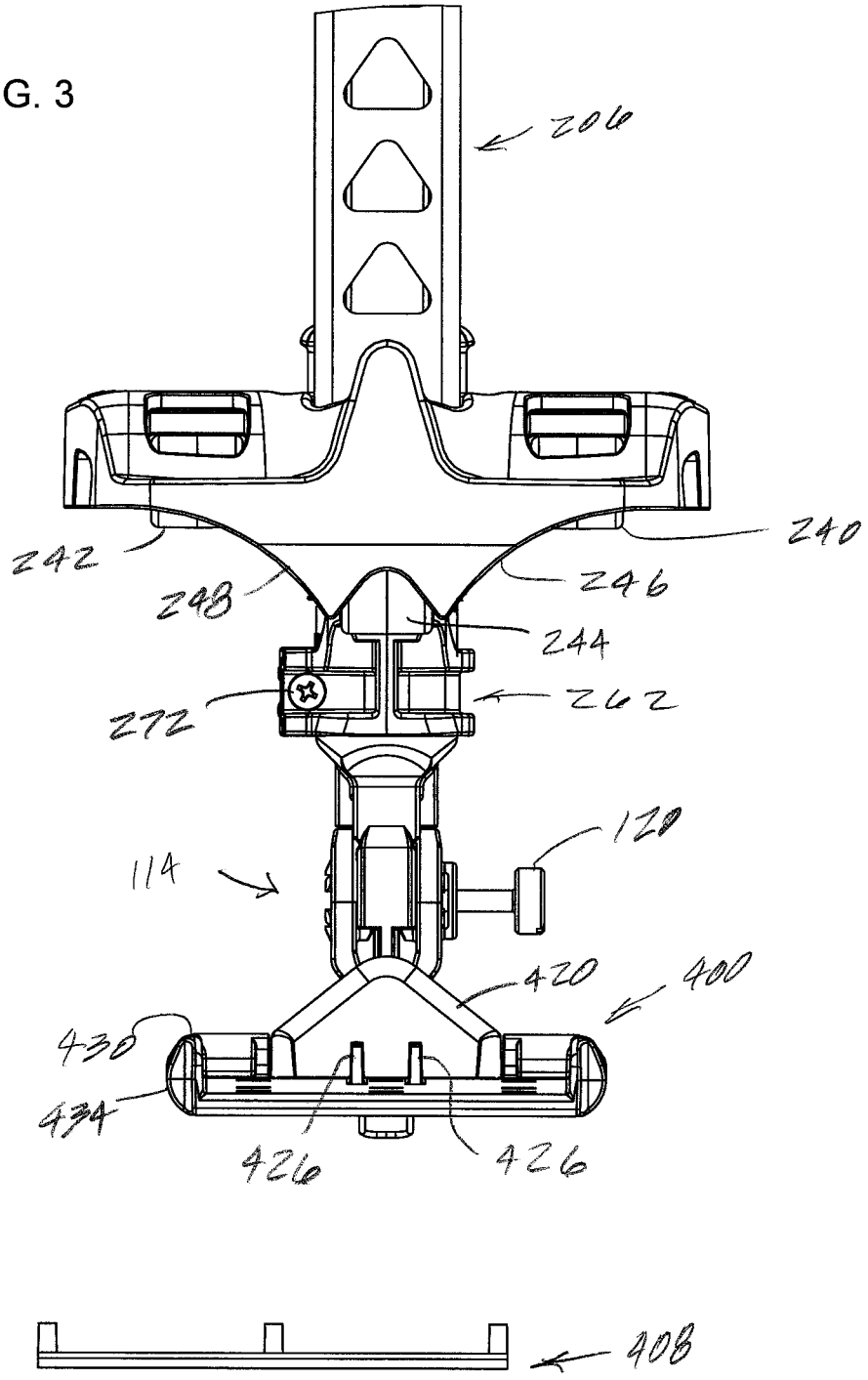
FIG. 3 is a left side elevation view of a detail of the mop assembly of FIG. 1.

Each pair of rollers 236 and 238, and 240 and 242 are spaced apart from each other corresponding to spacing of contact surfaces on the mop head assembly, described more fully below. As can be seen in FIG. 3, for example, the longitudinal center of a roller surface is aligned with its respective contact surface on the mop head assembly. Wringing functions can also be achieved additionally or alternatively with scraping surfaces or other friction surfaces. The rollers can be made from a material with a selected hardness, to provide a desired squeeze profile. Additionally, the rollers can have profiles including side surfaces that may be used to wring side portions of a mop assembly, for example edge or outside surfaces of respective rollers facing away from the handle and/or guideposts and configured to contact portions of the mop material. The rollers can be mounted in such a way as to allow adjustability of their positions in the wringing structure 220. Adjustability can be also incorporated into the pivot block 420, to allow adjustment of the spacing distance between the facing half plates. Such adjustability can allow variations in wringing pressure applied to the mop head assembly or mop size variations.

The wringing structure 220 in the illustrated configuration includes a pair of oppositely positioned and facing initiation rollers 242 and 244. The initiation rollers are positioned vertically spaced apart from and outboard of the pressure or wringing rollers 236, 238, 240 and 242, and are positioned and configured to make early contact with corresponding surfaces on the mop head assembly, described more fully below, to initiate folding or movement of the wings of the mop head assembly toward each other. The initiation rollers start the movement of the wings toward each other.

Figure 4:
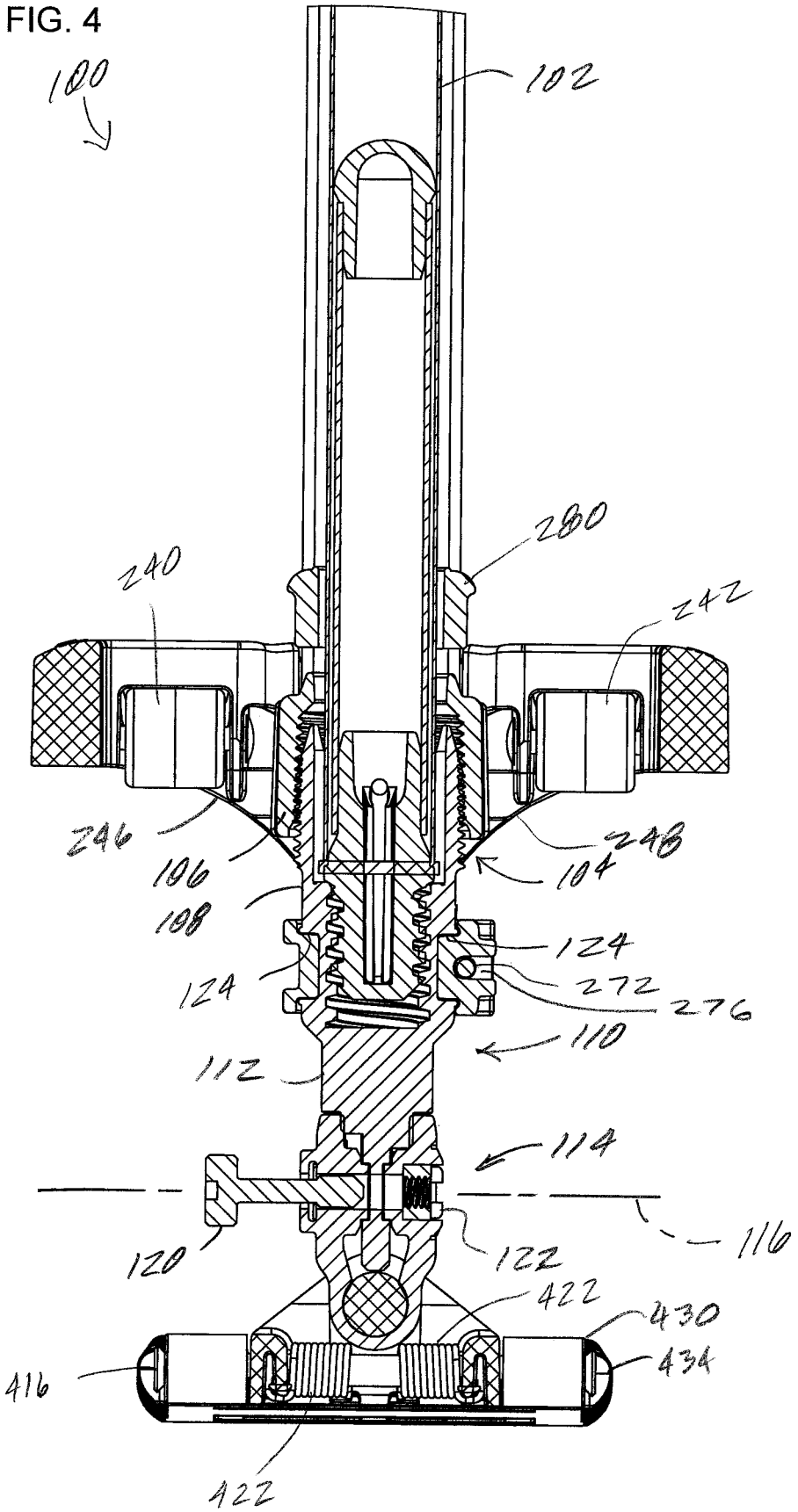
FIG. 4 is a sagittal section of a detail of the mop of FIG. 1.
Figure 5:
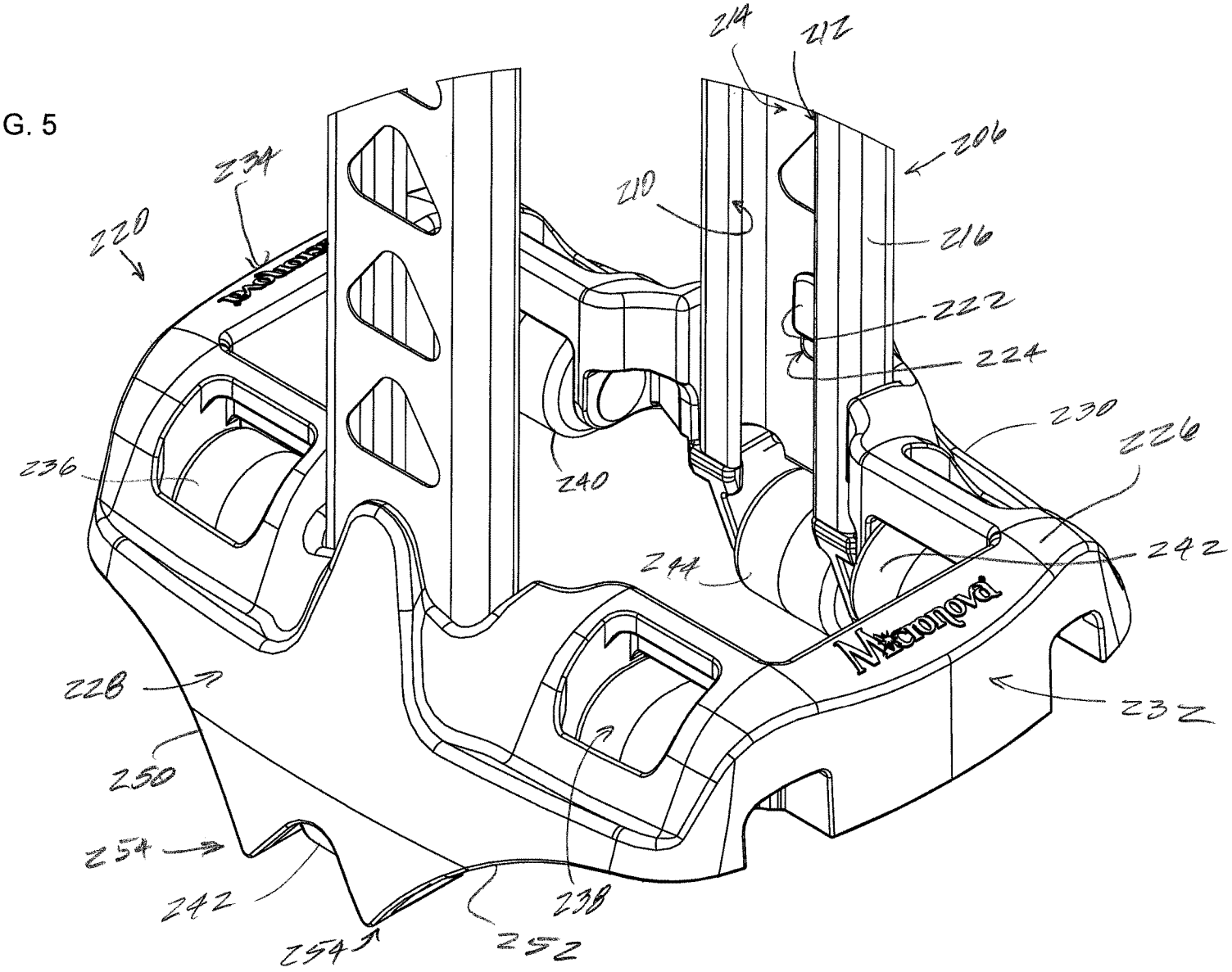
FIG. 5 is an upper left front isometric detailed view of part of a wringing assembly illustrated in FIG. 1.

The wringing structure 220 includes alignment or centering surfaces 246, 248, 250 and 252. The alignment surfaces are configured and positioned to contact and cam any surface of the mop head assembly that may be adjacent to the respective surface as a result of the mop head being tilted or pivoted out of a plane perpendicular to the handle 102 about the axis 118. The alignment surfaces help to align the mop head assembly prior to or during the initiation of folding or movement of the wings toward each other. Alignment helps to ensure that the wings are facing each other and fold toward an axis coaxial with the axis of the handle 102 for optimal wringing. Similarly, each of the initiation rollers 242 and 244 or their adjacent surfaces 254 on the wringing structure will contact the adjacent surfaces on the mop assembly if the mop assembly is pivoted out of a plane perpendicular to the handle 102 about the axis 116 (FIG. 4).

Lateral surfaces 298 (FIG. 6) in the wringing structure 220 can be configured to scrape or slide along any adjacent mop material to wring or scrape loose or excess moisture, for example where mop material extends around sides of the mop head assembly. With such mop attachments, other means can also be used to wring moisture from the side surfaces of the mop attachment. In one example, rollers (not shown) can be mounted at the surfaces 298 and facing perpendicular to the pressure rollers 236, 238, 240 and 242, and/or rollers or other surfaces can be profiled in such a way as to allow wringing or pressing of moisture from surfaces of the mop attachment.

The wringing assembly 200 also includes a guide 260 (FIGS. 1-4 and 6-9). The guide helps to guide the wringing structure 220 toward and away from the mop head assembly 400 and along the handle 102. The guide includes a mounting bracket 262 having an internal profile 264 for engaging a complementary profile on the handle. In the present example, the internal profile 264 is a rectangular arrangement of rails 266, each having a substantially rectangular profile, for engaging complimentary rectangular grooves 124 (FIG. 4) formed in a perimeter surface of the adapter 110. The guide 260 is longitudinally and rotationally fixed on the adapter through the engagement of the rails and the grooves. The guide 260 in the present configuration slides laterally onto the adapter and is secured in place by a bracket block 268 having a facing surface 270 engaging an adjacent groove in the adapter, and the bracket block 268 is secured in place by a bolt or other fastener 272 (FIG. 4) extending between spaced apart openings 274 in the guide and within a groove 276 in the bracket block.

The guide includes a guide block 280 supported by the mounting bracket 262. The guide block 280 includes structures for helping to guide the wringing assembly toward and away from the mop head assembly 400. In the present example, the guide block 280 is supported above the mounting bracket 262 by right and left support arms 282 and 284, respectively, so that the guide block is positioned above the fastening nut 106. In the present example, the support arms include respective detent grooves 286 and 288 for receiving respective ones of the initiation rollers, 242 and 244. The detent grooves and the rollers hold the wringing structure 220 in place on the guide 260 until a sufficient force is applied to the manual grip 202 or other part of the wringing structure to move the initiation rollers 242 and 244 out of the detent grooves. The detents are positioned on the guide 260 at an axial position sufficient to keep the wringing assembly away from the mop head assembly during normal use of the mop. Other configurations such as lock features or other structures can be used to hold the wringing assembly in position when not being used. The guide also serves as an upper and lower stop structure to limit the travel of the wringing assembly.

The guide 260 includes a plurality of guide surfaces for guiding the guideposts as the wringing structure 220 moves along the guide 260. In the present example, the guide 260 includes four guide surfaces 290 positioned at respective corners of the guide block 280, and are substantially coplanar in the illustrated configuration. Each of the guide surfaces 290 is formed by a longitudinally extending groove having curved surfaces to form a concave profile. The concave profile is configured to accept and guide complementary surfaces on the guideposts 206 and 208. In the present configuration, the four guide surfaces 290 are positioned at the top of the guide 260 and assist in keeping the guideposts spaced apart.

Figure 7:
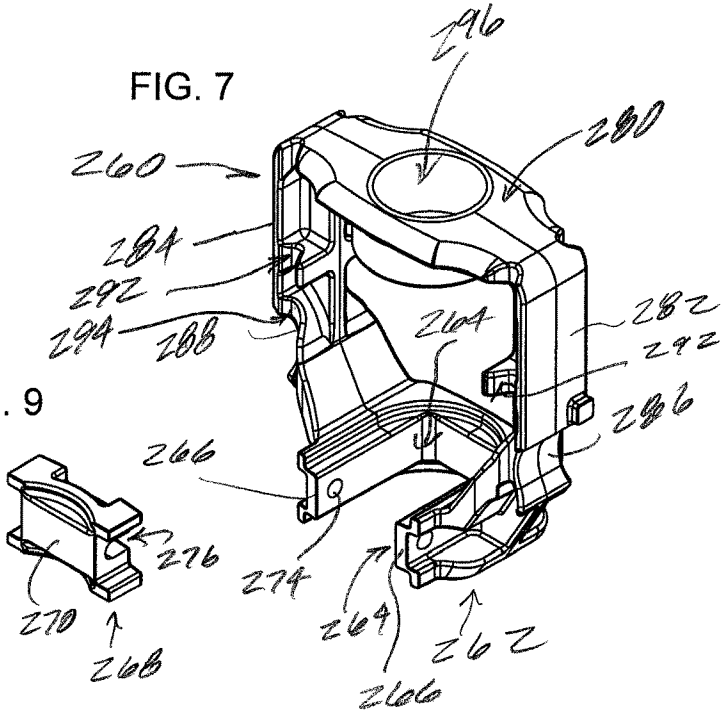
FIG. 7 is an upper right rear isometric view of a guide for the wringing assembly of FIG. 1.
Figure 8:
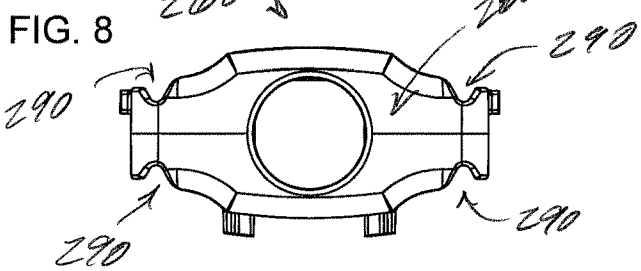
FIG. 8 is a top plan view of the guide of FIG. 7.
Figure 9:
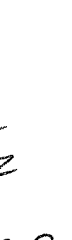
FIG. 9 is an upper rear isometric view of a spacer for use with the guide of FIGS. 7-8.
Figure 6:
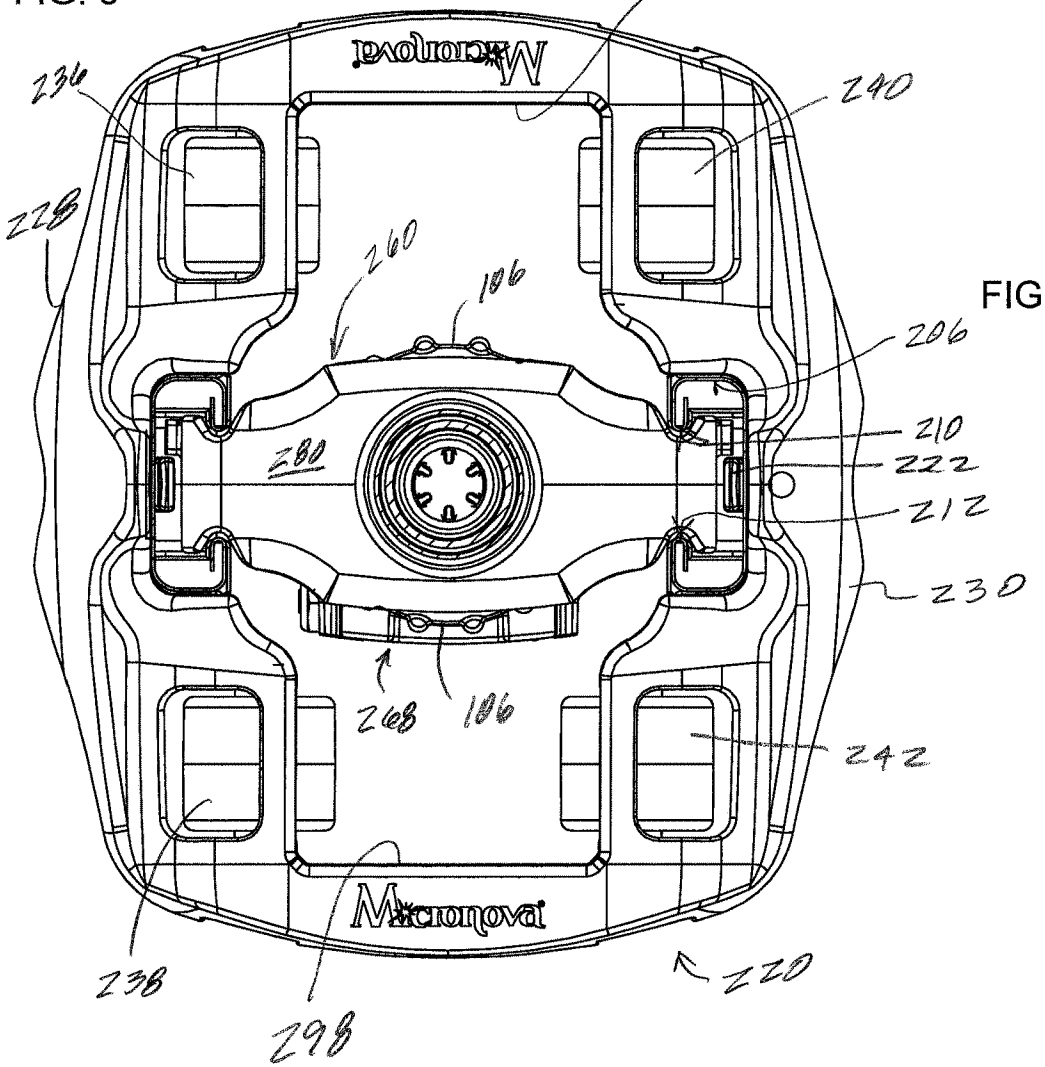
FIG. 6 is a top plan and partial section view of the mop assembly of FIG. 1 without the mop head.
Figures 10, 11:
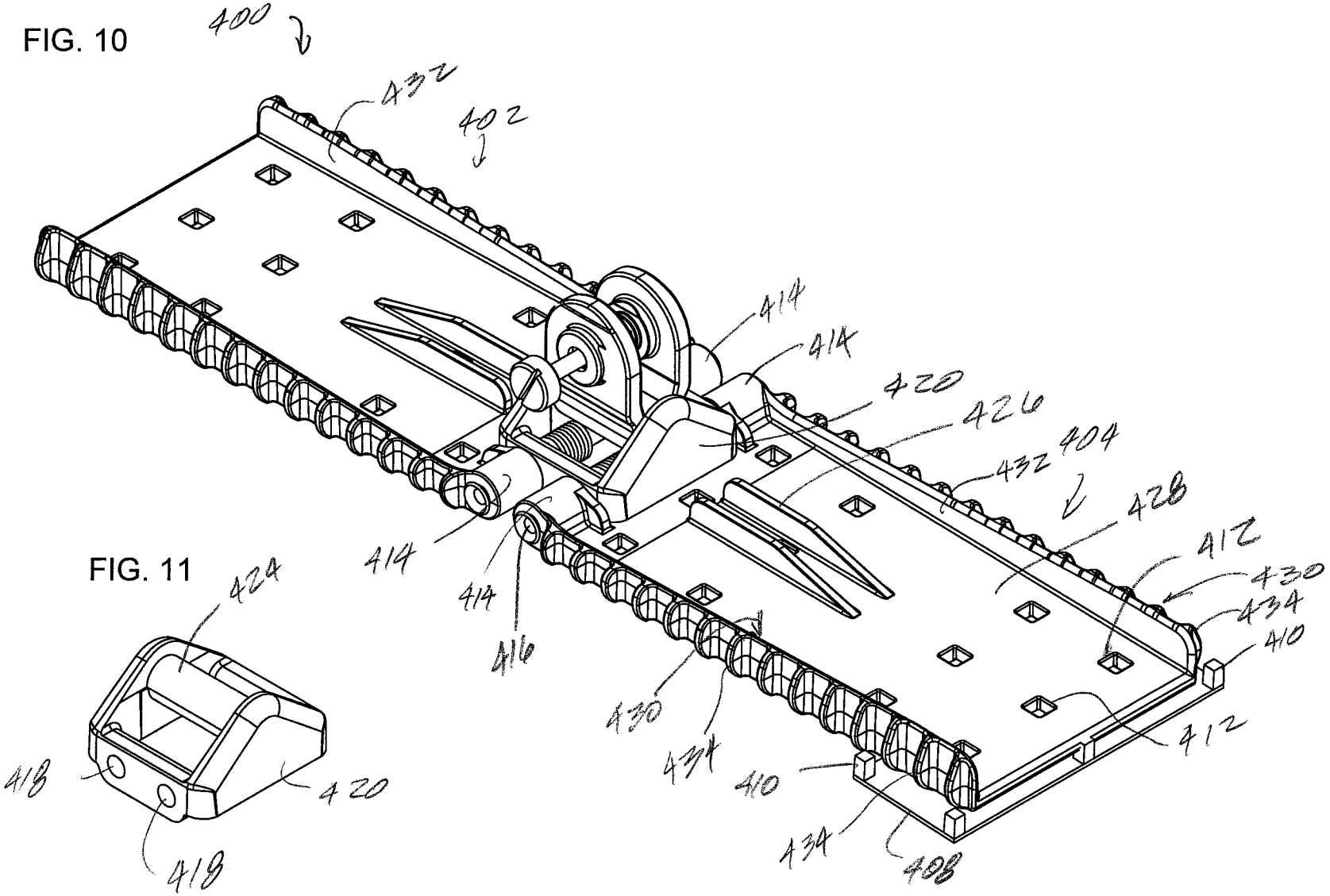
FIG. 10 is an upper left front isometric view of a mop head assembly used with the mop assembly of FIG. 1.
FIG. 11 is an upper left front isometric view of a pivot mount of the mop head assembly of FIG. 10.
Figure 14:
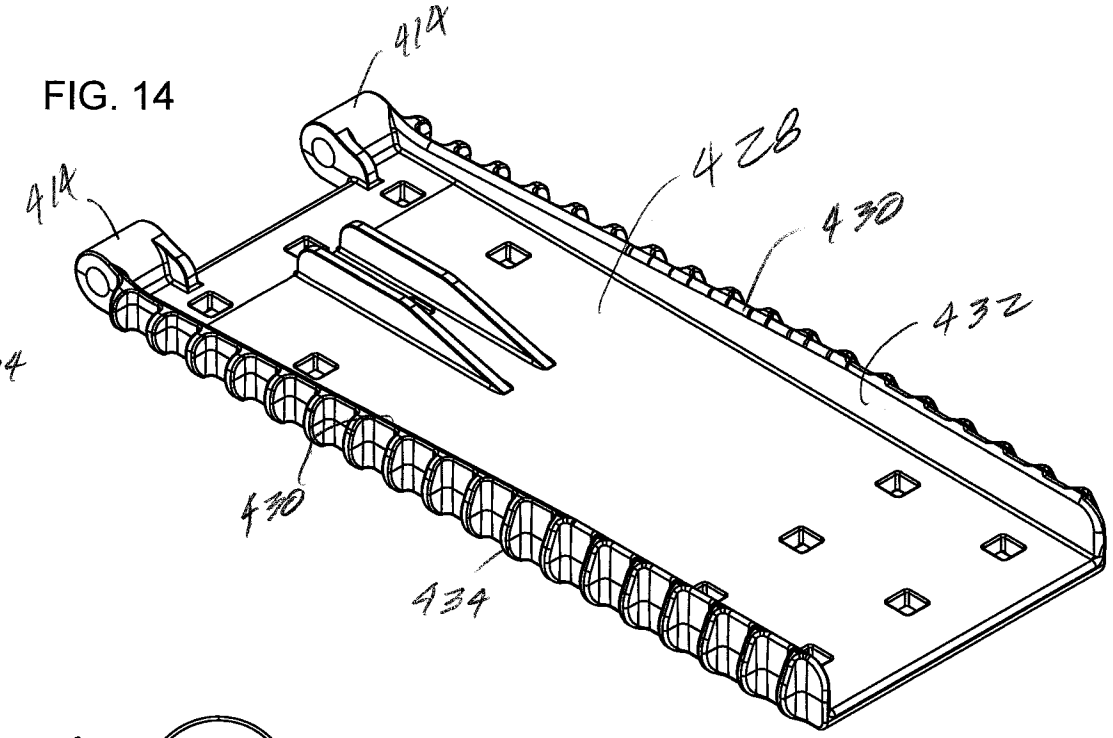
FIG. 14 is an upper isometric view of a half plate or wing of the mop head assembly of FIG. 10.
Figure 12:
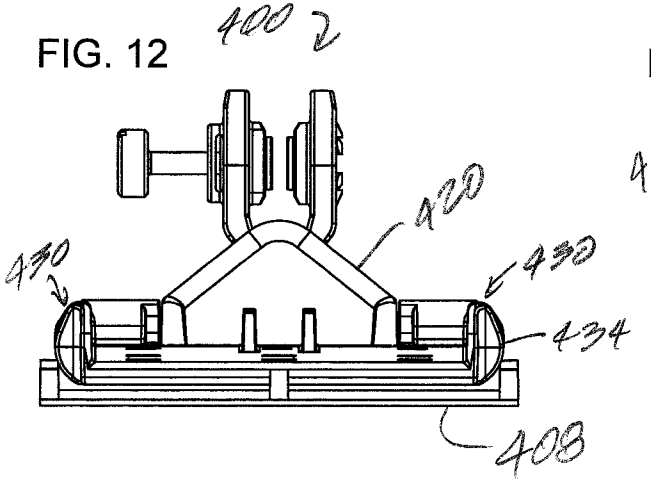
FIG. 12 is a left plan view of the mop head assembly of FIG. 10.

In the present example, the guide 260 includes four additional guide surfaces 292. The additional guide surfaces 292 are positioned and supported on structures on the respective right and left support arms 282 and 284 of the guide. The additional guide surfaces 292 are aligned with respective ones of the four guide surfaces 290. As with the four guide surfaces 290, the additional guide surfaces 292 have arcuate surfaces forming concave profiles complimentary to the guideposts. The guide can also include additional guide surfaces of either the same or different configurations as the guide surfaces 290 and 292. In the present example, the guide includes further guide surfaces 294, one of which is shown in FIG. 7. In the present configuration, the guide would include four guide surfaces 294, each substantially aligned with respective ones of the guide surfaces 290 and 292.

The mop head assembly 400 (FIGS. 1 and 10-14) in the illustrated examples is a bi-plane, winged or bi-plate mop assembly having right and left half plates 402 and 404, respectively. The half plates are substantially mirror images of each other, but each can be used on either side. Each half plate includes a substantially planar bottom surface 406 for supporting a suitable mop material (not shown). Alternatively, a plurality of mop attachment plates can be used to attach mop material to the half plates, one mop attachment plate 408 being illustrated in the Figures. The mop attachment plate includes a plurality of mounting posts 410 for engaging respective openings 412 in the surface of the half plate. The mop attachment plates can have hook or other attachment configurations for removably attaching mop material, such as may include loop material for engaging with the hook structures on the attachment plates. In the illustrative configurations, each half plate would include two mop attachment plates. In such a configuration, the mop material would generally be a planar material attached to the attachment plates, for example a single mop material segment extending across both half plates, without extending up sides of the half plates.

Figure 16:
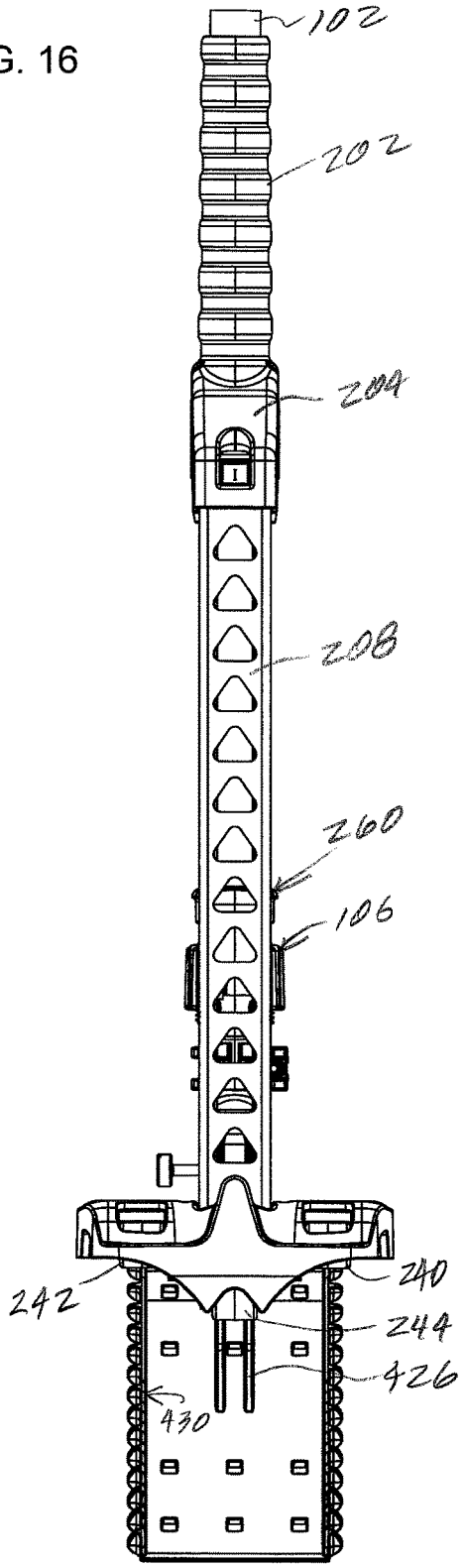
FIG. 16 is a left plan view of the assembly shown in FIG. 15.
Figure 18:
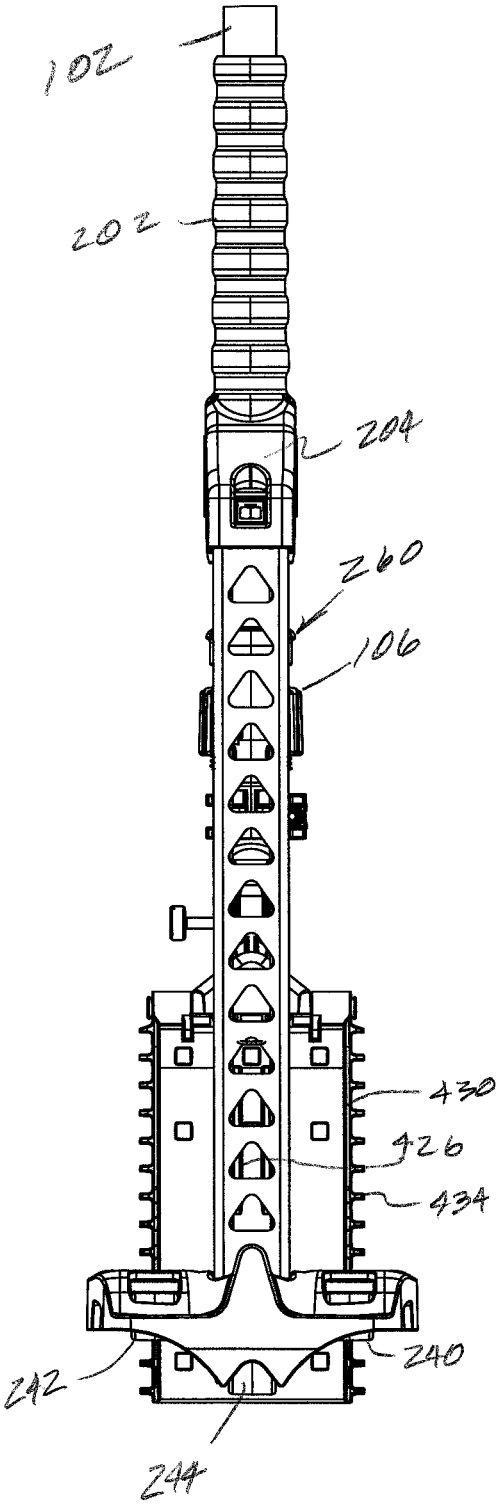
FIG. 18 is a left plan view of the assembly shown in FIG. 17.

Each half plate is generally rectangular in plan view, such as viewed in FIGS. 16 and 18, and is assembled into the assembly at a distal side by way of hinge structures 414 having a pin 416 extending between respective hinge structures. The pins 416 pass through respective openings 418 in a pivot mounting bracket 420 for securing and supporting the half plates to the articulating assembly 114. The pins 416 also support respective springs 422 that bias the half plates to the co-planar, open configuration shown in FIGS. 1 and 10. The U-bracket of the articulating assembly 114 supports and allows the mop head assembly to pivot about an axle 424 (FIG. 11) in the pivot mounting bracket 420. The pivot mounting bracket 420 also maintains the half plates at the desired spacing relative to each other.

Figure 13:
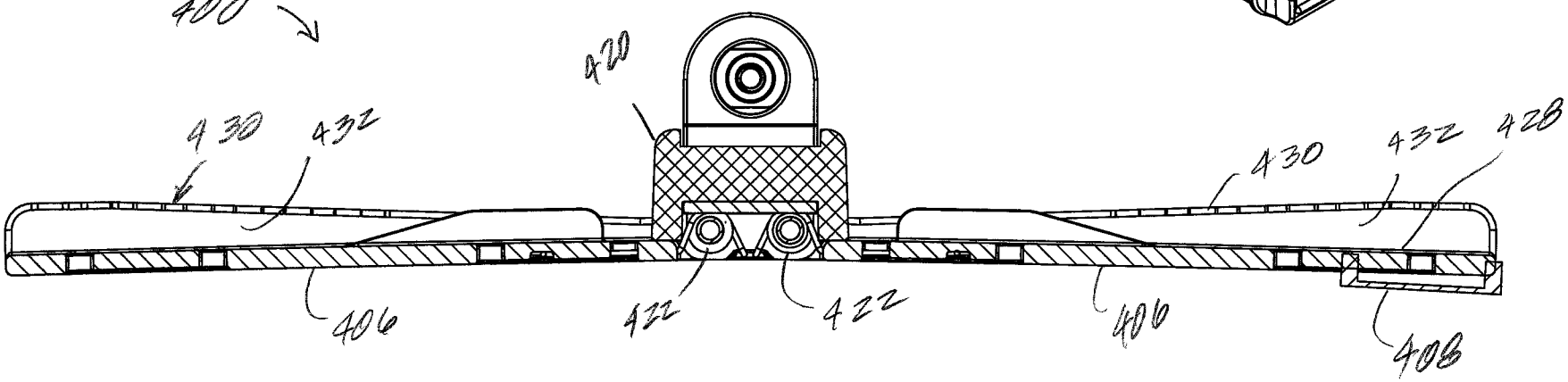
FIG. 13 is a transverse vertical section of the mop head assembly of FIG. 10.

Each half plate includes one or more preliminary cam folding surfaces 426. The preliminary cam surfaces are raised from an upper surface 428 of the half plate a distance sufficient to come into contact with a respective initiation rollers 242, 244, for example to start folding of the bi-plates before the pressure rollers 236, 238, 240 and 242 contact the respective bi-plates. As can be seen in FIG. 13, the vertical height of the preliminary cam surfaces relative to the upper surface 428 is greater than the vertical height of side edges of the bi-plates at the same longitudinal location from the hinge structures 414. The preliminary cam surfaces extend longitudinally of the respective bi-plate less than the entire length of the bi-plate.

Each bi-plate includes at least one wringing surface 430, and in the present examples two wringing surfaces extending upward from the upper surface 428 of the respective bi-plate. The wringing surfaces are contacted by corresponding structures on the wringing assembly, in the present example corresponding pressure rollers 236, 238, 240 and 242 to apply pressure to the bi-plates and press them together to apply pressure to the mop material mounted on the bi-plates. The wringing surfaces can be positioned at a number of locations on the bi-plate, and in the present example are configured as vertically-extending walls 432 at side edges of the bi-plate. In the illustrative configurations, the wringing surfaces 430 are positioned at respective opposite perimeter surfaces or edges of the respective bi-plate, and extend upward or away from the surface to be cleaned. In the present examples, the vertically-extending walls are substantially aligned with center portions of the corresponding pressure roller surfaces. In other examples, the raised wringing surfaces can include portions or each be completely inboard from the perimeter edge surfaces by a distance as much as 20% of the front to back (or distal to proximal) distance opposite edges of the mophead, but more preferably about 10% or less. As illustrated, the raised wringing surfaces are at the perimeter edges.

The upper surface of the vertically-extending wall 432 can have a number of configurations, depending in part on the desired pressure profile to be applied to the bi-plate during the wringing operation. The wall 432 can have a constant height from the upper surface 428, but in the illustrated examples, the height of the wall 432 increases with distance from the hinge structure 414, and also as illustrated, the increase is relatively constant. Such a configuration applies greater pressure as the wringing action progresses. In the present examples, the walls 432 extend substantially the entire length of the bi-plate.

External surfaces of the vertically-extending wall 432 include convex support structures in the form of convex walls 434 extending laterally outward from the respective wall 432. The convex walls 434 help cleaning coving and other similar surface profiles, and also help to reinforce the vertically extending walls.

In operation, a mop assembly 100 (FIGS. 15-18) will have the handle 102 inserted through the handgrip 202 and the opening 296 in the top of the guide block 280 and into the adapter and secured with the nut 106. The guide 260 is already secured to the adapter through the fastener 272 and the block 268, to mount the wringing assembly on the adapter.

Figure 15:
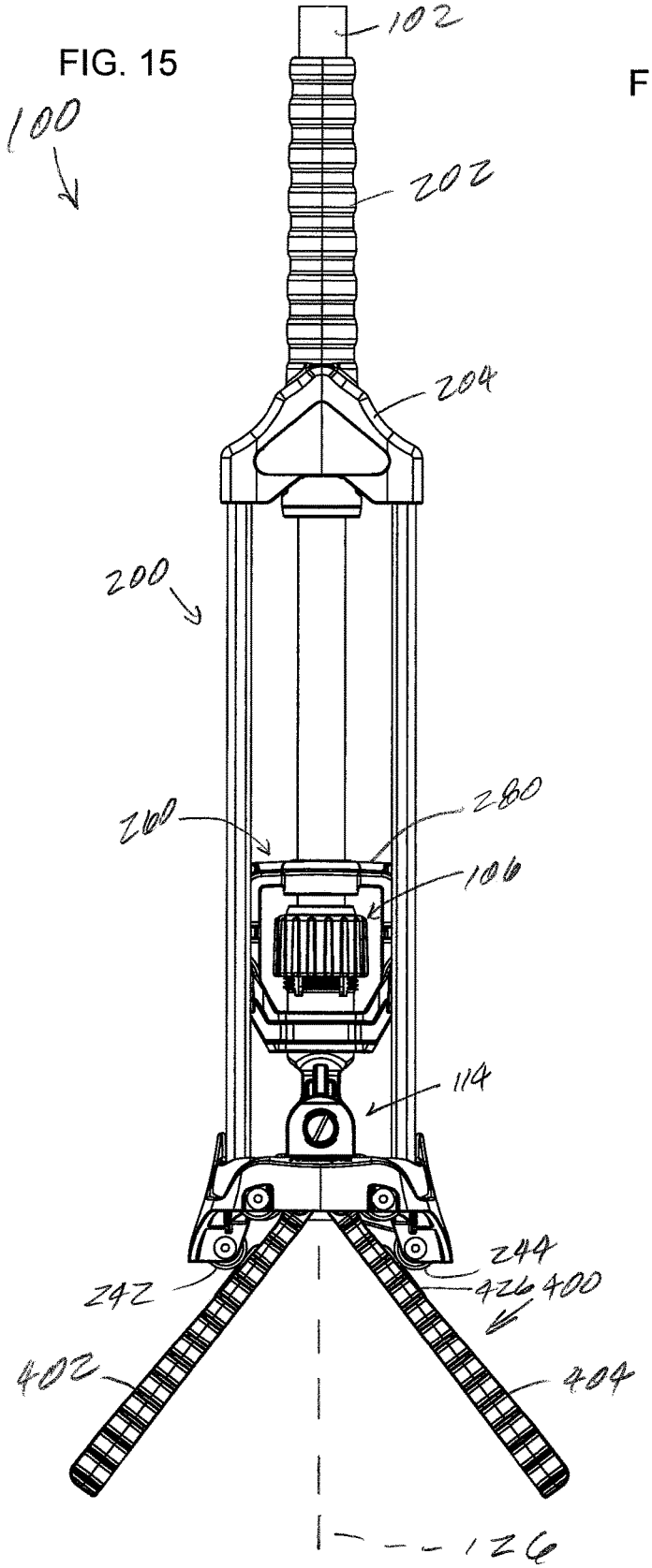
FIG. 15 is a front plan view of a detail of the mop assembly of FIG. 1 part way into a wringing configuration.

The user grasps the handle 102 and the manual grip 202 and moves the manual grip distally along the handle, thereby moving the wringing assembly 200 distally toward the mop head assembly 400. The guide 260 and the guide surfaces 290, 292 and 294 help to guide the guideposts and keep the wringing assembly coaxial with the handle. As the wringing assembly approaches the mop head assembly, the mop head assembly is self-aligned by the action of any contact between the mop head assembly and the cam surfaces 246, 248, 250 and 252, and 254. As the wringing assembly continues advancing distally, the initiation rollers 242 and 244 contact the cam surfaces 426 on the half plates, and start folding the half plates toward each other and toward a central axis 126 of the handle (FIG. 15). Once contact occurs, continued forward or distal progress of the wringing assembly continues to push the initiation rollers 242 and 244 against the cam surfaces 426 and pivot the half plates 402 and 404 closer to each other about their respective hinges.

Figure 17:
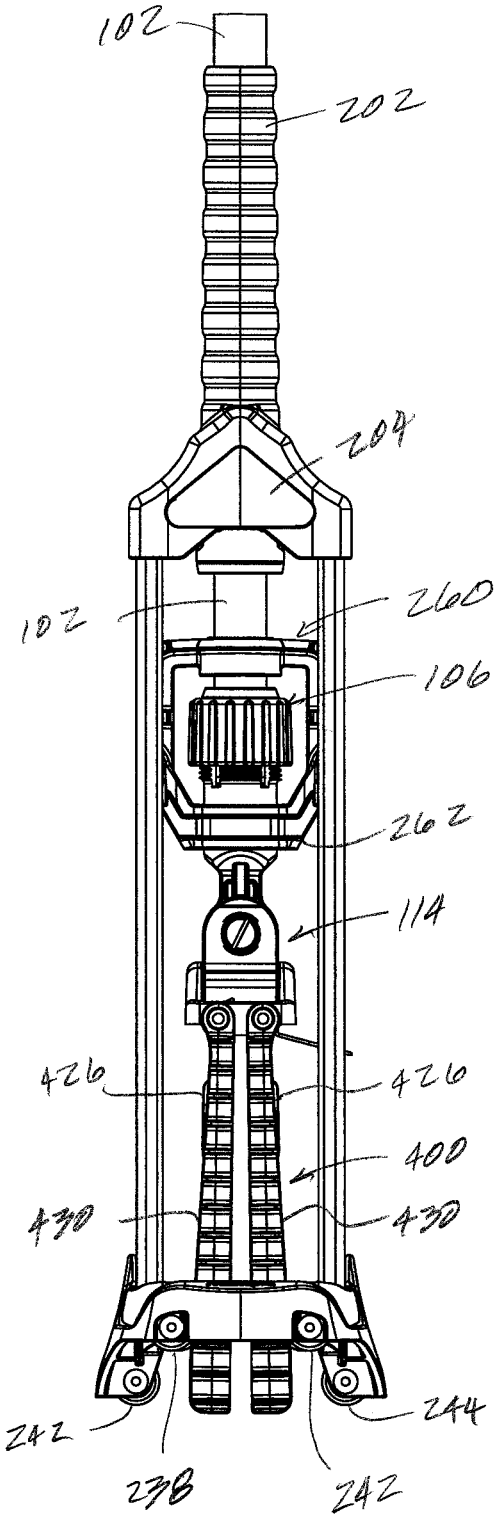
FIG. 17 is a front plan view of a detail of the mop assembly of FIG. 1 further into a wringing configuration.

As the wringing assembly progresses, the initiation rollers 242 and 244 move further along the cam surfaces 426, and the pressure rollers 236, 238, 240 and 244 contact the corresponding wringing surfaces 430 to press the spaced apart half plates toward each other. In the present configuration, further progress applies greater pressure because of the increasing height of the wringing surfaces 430 with distance away from the hinge sides (FIGS. 17-18). As wringing continues, the mop material is squeezed to remove additional moisture as desired. The amount of wringing will be a function of the relative distance the wringing assembly is progressed along the handle and of the surface profile of the wringing surfaces 430. Suitable markings can be placed on the handle to provide a relative measure of the wringing as a function of position along the handle. Additionally, one or more stops can be applied to physically limit the progress of the wringing assembly along the handle, and therefore the wringing action. Such markings and/or physical limits may also be used with different sizes of mop assemblies to account for variations in the lengths of the half plates. Alternatively, or additionally, different lengths of guideposts can be used for selected mop head assemblies, for example as a function of the length of the half plates.

In another configuration, the initiation rollers 242 and 244 can be omitted in favor of the adjacent surfaces, which then contact the respective half plates, if the cam surfaces are sufficiently high to be contacted prior to the pressure rollers contacting the wringing surfaces 430. If not, the pressure rollers contact the wringing surfaces to bias the half plates toward each other and eventually begin wringing.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other, the mop head element comprising a lower surface for receiving a cleaning material for mopping a surface, an upper surface on an opposite side of the mop head element from the lower surface, a first end portion configured to be supported by a mop wherein the first end portion extends in first and second substantially opposite directions, first and second side portions extending outward from the first end portion to a second end portion wherein first and second edge portions are opposite each other, and wherein the first and second edge portions include upper surfaces configured to be contacted by wringing surfaces on a mop for wringing the cleaning material on the lower surface of the mop head element, wherein at least one side portion includes a side portion surface that is one of convex, V-shaped, and C-shaped in a direction substantially perpendicular to the lower surface.

2. The mop of claim 1 wherein the first end portion includes a hinge portion.

3. The mop of claim 1 wherein the mop head element further includes a bias element for biasing the mop head element in a selected direction of rotation.

4. The mop of claim 1 wherein the upper surface includes substantially planar portions and the first and second side portions extend away from the upper surface.

5. The mop of claim 1 wherein the mop head element extends a first distance between the first and second perimeter edge portions adjacent respective ones of the first and second side portions and wherein the first side portion is spaced a second distance from the first perimeter edge portion wherein the second distance is 20% or less of the first distance.

6. The mop of claim 1 wherein the mop head element extends a first distance between the first and second perimeter edge portions adjacent respective ones of the first and second side portions and wherein the first side portion is spaced a second distance from the first perimeter edge portion wherein the second distance is 10% or less of the first distance.

7. The mop of claim 1 wherein the first and second side portions form respective first and second perimeter edge portions.

8. The mop of claim 1 wherein each of the first and second side portions extend in a direction away from the upper surface opposite the lower surface a height wherein the height changes with distance away from the first end portion.

9. The mop of claim 8 wherein each of the first and second side portions extend away from the upper surface for all of a length of the mop head element.

10. The mop of claim 8 wherein each of the first and second side portions extend away from the upper surface for less than all of a length of the mop head element.

11. The mop of claim 1 wherein a side perimeter edge portion includes a convex surface.

12. The mop of claim 1 further including at least one cam surface on an upper surface of the mop head element positioned between the first and second side portions.

13. The mop of claim 12 wherein the at least one cam surface includes a portion that is sloped.

14. The mop of claim 1 wherein a side perimeter edge portion includes a V-shaped profile.

15. The mop of claim 1 wherein a side perimeter edge portion includes C-shaped profile.

16. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other, wherein the respective first and second pressure-applying elements are positioned so as to be centered over respective ones of the first and second side portions of the mop head element.

17. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other, wherein the mop includes at least two mop head elements and wherein the mop includes at least four pressure-applying elements configured to apply pressure to the respective side portions of the at least two mop head elements, wherein the at least four pressure-applying elements comprise four pressure-applying elements in the form of one or more of rollers, blades, scrapers or moisture shedding structures positioned with respect to each other so as to define a rectangle, and wherein the pressure-applying elements are supported spaced apart from each other.

18. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other further including an articulating interface allowing the at least one mop head element to pivot about two independent axes.

19. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other further including a handle and a wringing assembly supported and guided by the handle, wherein the wringing assembly includes a guide supported on the handle and interengaging columns such that the columns are guided by the guide during movement of the columns.

20. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other, further including a wringing frame configured such that the wringing frame produces four areas of pressure during wringing of a mop head element.

21. The mop of claim 20 wherein first and second areas of pressure apply pressure opposite each other and third and fourth areas of pressure apply pressure opposite each other.

22. A self-wringing mop including a mop head element wherein the mop includes a wringing element having first and second pressure-applying elements having respective first and second axes of rotation and configured to apply pressure to first and second side portions of the mop head element, and further including an additional pressure-applying element having a respective third axis of rotation non-colinear with the first and second axes, wherein the pressure-applying elements are supported spaced apart from each other and wherein the wringing element includes alignment or centering surfaces configured to align or center the mop head element with respect to the wringing element.

23. The mop of claim 22 wherein the alignment or centering surfaces are configured to move the mop head element out of a plane perpendicular to a handle of the mop.

24. A mop head element comprising a lower surface for receiving a cleaning material for mopping a surface, an upper surface on an opposite side of the mop head element from the lower surface, a first end portion configured to be supported by a mop wherein the first end portion extends in first and second substantially opposite directions, first and second side portions extending outward from the first end portion to a second end portion wherein the first and second side portions are opposite each other, wherein at least one side portion includes a surface V-shaped in a direction substantially perpendicular to the lower surface and wherein the first and second side portions include upper surfaces configured to be contacted by wringing surfaces on a mop for wringing the cleaning material on the lower surface of the mop head element.

25. A mop head element comprising a lower surface for receiving a cleaning material for mopping a surface, an upper surface on an opposite side of the mop head element from the lower surface, a first end portion configured to be supported by a mop wherein the first end portion extends in first and second substantially opposite directions, first and second side portions extending outward from the first end portion to a second end portion wherein the first and second side portions are opposite each other, wherein at least one side portion includes a surface C-shaped in a direction substantially perpendicular to the lower surface and wherein the first and second side portions include upper surfaces configured to be contacted by wringing surfaces on a mop for wringing the cleaning material on the lower surface of the mop head element.

* * * * *